United States Patent [19]

Miller et al.

[11] 4,014,662

[45] Mar. 29, 1977

[54] POLYMER COMBINATIONS USEFUL IN FUEL OIL TO IMPROVE COLD FLOW PROPERTIES

[75] Inventors: Harold N. Miller, Millington; Max J. Wisotsky, Highland Park, both of N.J.

[73] Assignee: Exxon Research and Engineering Company, Linden, N.J.

[22] Filed: Oct. 10, 1975

[21] Appl. No.: 621,462

Related U.S. Application Data

[63] Continuation-in-part of Ser. No. 616,753, Sept. 19, 1975, abandoned.

[52] U.S. Cl. ..... 44/62; 44/70; 44/76

[51] Int. Cl.[2] ..... C10L 1/24

[58] Field of Search ..... 44/62, 70, 76

[56] References Cited

UNITED STATES PATENTS

| | | | |
|---|---|---|---|
| 3,442,790 | 5/1969 | Burkard et al. | 44/62 |
| 3,454,379 | 7/1969 | Isaacson et al. | 44/62 |
| 3,638,349 | 2/1972 | Wisotsky et al. | 44/62 |
| 3,645,704 | 2/1972 | Burkard et al. | 44/62 |

*Primary Examiner*—Daniel E. Wyman
*Assistant Examiner*—Mrs. Y. Harris-Smith
*Attorney, Agent, or Firm*—Roland A. Dexter; Frank T. Johmann

[57] ABSTRACT

Ethylene polymers in combination with an oil-soluble sulfone copolymer having a ($\overline{M}n$) of from about 800 to 500,000 improve the cold flow properties of distillate hydrocarbon oils.

8 Claims, No Drawings

POLYMER COMBINATIONS USEFUL IN FUEL OIL TO IMPROVE COLD FLOW PROPERTIES

This is a continuation-in-part application of U.S. patent application Ser. No. 616,753 filed Sept. 19, 1975 now abandoned entitled "Polymer Combinations Useful In Fuel Oil To Improve Cold Flow Properties"—Case PT-270 having the inventors Harold N. Miller and Max J. Wisotsky.

BACKGROUND OF THE INVENTION

1. Field of the Invention

The invention relates to an additive combination of (a) an ethylene backbone middle distillate fuel oil pour depressant polymer with (b) a second polymer comprising an oil-soluble sulfone copolymer. This combination is particularly useful in middle distillate fuel oils containing a fraction boiling above 175° C. for controlling the size of wax crystals that form at low temperatures.

2. DESCRIPTION OF THE PRIOR ART —

Various polymers, useful as middle distillate pour point depressants, prepared from ethylene have been described in the patent literature. These pour depressants include co-polymers of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); chlorinated polyethylene (Belgium Pat. No. 707,371 and U.S. Pat. No. 3,337,313); etc.

The sulfone copolymer products resulting from the polymerization of sulfur dioxide with unsaturated compounds such as unsaturated alcohols, ethers, esters and acids are well known in the art as for example as seen from U.S. Pat. No. 2,114,292. It is also known to react sulfur dioxide with olefins and ethylenically unsaturated polar compounds as for example is seen from U.S. Pat. Nos. 2,241,900, 2,645,631, 3,563,961 and 3,684,778. These copolymers of sulfur dioxide and ethylenically unsaturated polar compounds were prepared by various processes, including bulk, solution and emulsion polymerization.

U.S. Pat. No. 2,652,368 describes the use of alkylene sulfone copolymers of $SO_2$ and olefins in lubricating oil compositions to enhance its viscosity temperature performance in torque converters. These copolymers were obtained by the polymerization of alpha-olefinic hydrocarbons having from 7 to 24 carbon atoms with $SO_2$ at the latter's reflux temperature and in the presence of a catalyst such as peroxides and nitrates.

U.S. Pat. No. 3,442,790 teaches olefin and sulfur dioxide copolymers as wax crystal modifiers. These materials are added to wax-containing petroleum oil materials, for example, so as to modify the size and shape of wax crystals in such a manner as to permit more rapid separation of the wax during the dewaxing of the hydrocarbon oil.

SUMMARY OF THE INVENTION

The present invention is based on the finding that ethylene backbone polymers in combination with a copolymer of $SO_2$ and a $C_2C_{50}$ olefin, preferably mixtures thereof and, if desired, ethylenically unsaturated polar monomers, having an ($\overline{M}_n$) of about 800 to 500,000 can give synergistic reduction in the cold flow properties of distillate hydrocarbon oils.

In general, the additive combination of the invention will comprise one part by weight of the ethylene backbone polymer per about 0.05 to 20, preferably 0.2 to 5, parts by weight of said oil-soluble sulfone copolymer. The distillate hydrocarbon oil compositions of the invention will contain a total of about 0.001 to 1.5, preferably 0.005 to 0.1 wt. %, of said additive combination. Concentrates of 1 to 60 wt. % of said additive combination in 40 to 99 wt. % of mineral oil, e.g., kerosene, can be prepared for ease of handling and admixture when required with the distillate hydrocarbon oils.

THE ETHYLENE POLYMER

The ethylene polymers have a polymethylene backbone which is divided into segments by hydrocarbon, halogen, or oxy-hydrocarbon side chains. They may be simply homopolymers of ethylene, usually prepared by free radical polymerization which results in some but limited branching. More usually, they will comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight, designated throughout as $\overline{M}_n$, in the range of at least about 1000 to 60,000, preferably about 1,200 to about 7,000. ($\overline{M}_n$) values reported in this specification are measured by Vapor Pressure Osmometry (VPO) up to about 25,000 and by Membrane Osmometry above about 25,000.

The unsaturated monomers, copolymerizable with ethylene, include unsaturated mono- and diesters of the general formula:

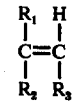

wherein $R_1$ is hydrogen or methyl; $R_2$ is a —$OOCR_4$ or —$COOR_4$ group wherein $R_4$ is hydrogen or a $C_1$ to $C_{16}$, preferably a $C_1$ to $C_8$, e.g., $C_1$ to $C_4$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_2$ to $C_{17}$ monocarboxylic acid, preferably $C_2$–$C_9$, e.g., $C_2$ $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, 2-ethyl hexyl acrylate, methyl methacrylate, lauryl acrylate, $C_{13}$ Oxo alcohol esters of methacrylic acid, etc. Examples of monomers where $R_1$ is hydrogen and $R_2$ and $R_3$ are —$COOR_4$ groups, include mono- and diesters of unsaturated dicarboxylic acids such as: mono-$C_{13}$ Oxo fumarate, di-$C_{13}$ Oxo fumarate, diisopropyl maleate; di-lauryl fumarate, ethyl methyl fumarate; etc.

Another class of monomers that can be copolymerized with ethylene include $C_3$ to $C_{16}$, e.g. $C_3$ to $C_8$, alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by chlorinating polyethylene, e.g., to a chlorine content of about 10 to 35 wt. %. Or, as previously mentioned, branched polyethylene can be used per se as the polymer.

These oil soluble ethylene polymer pour depressants are generally formed using a free radical promoter, or in some cases they can be formed by thermal polymerization, or they can be formed by Ziegler catalysis in the case of ethylene with other olefins. The polymers produced by free radical appear to be the more important and can be formed as follows: Solvent, and 0–50 wt. %, of the total amount of monomer other than ethylene; e.g., an ester monomer, used in the batch, are charged to a stainless steel pressure vessel which is equipped with a stirrer. The temperature of the pressure vessel is then brought to the desired reaction temperature, e.g., 70° to 250° C., and pressured to the desired pressure with ethylene, e.g., 700 to 25,000 psig, usually 900 to 7,000 psig. Preferred are temperatures in the range of 70° to 160° C. Promoter, usually dissolved in solvent so that it can be pumped, and additional amounts of the second monomer (if any), e.g., unsaturated ester, can be added to the vessel continuously, or at least periodically, during the reaction time, which continuous or periodic addition gives a more homogeneous copolymer product as compared to adding all the unsaturated ester at the beginning of the reaction. Also during this reaction time, as ethylene is consumed in the polymerization reaction, additional ethylene can be supplied through a pressure controlling regulator so as to maintain the desired reaction pressure fairly constant at all times. Following the completion of the reaction, usually a total reaction time of ¼ to 10 hours will suffice, the liquid phase of the pressure vessel contents is distilled to remove the solvent and other volatile constituents of the reacted mixture, leaving the polymer as residue. Usually to facilitate handling and later oil blending, the polymer is dissolved in a light mineral oil to form a concentrate usually containing 10 to 60 wt. % of polymer.

Usually, based upon 100 parts by weight of polymer to be produced, then about 50 to 1200, preferably 100 to 600 parts by weight of solvent, usually a hydrocarbon solvent such as benzene, hexane, cyclohexane, etc., and about 1 to 20 parts by weight of promoter will be used.

The promoter can be any of the conventional free radical promoters, such as peroxide or azo-type promoters, including the acyl peroxides of long chain brancehd or unbranced carboxylic acids, as well as other common promoters. Specific examples of such promoters include dibenzoyl peroxide, di-tertiary butyl peroxide, t-butyl perbenzoate, t-butyl peroctoate, t-butyl hydroperoxide, alpha, alpha', azodiisobutyronitrile, dilauroyl peroxide, etc. Dilauroyl peroxide is preferred when the polymer is made at a low temperature, e.g., 70° to 135° C. while di-tert, butyl peroxide is preferred at higher polymerization temperatures.

THE SULFONE COPOLYMERS

The oil-soluble sulfone copolymers useful in this invention are generically copolymers of sulfur dioxide and $C_2$–$C_{50}$ alpha olefin mixtures (in preferred form the copolymers of sulfur dioxide and mixtures of two or more alpha olefins having from 10 to about 22 carbon atoms) and, if desired, contain one or more ethylenically unsaturated polar monomers. The useful sulfone copolymers have a ($\overline{M}_n$) ranging from about 400 to about 750,000, preferably from about 600 to about 500,000.

The polysulfone copolymers useful in this invention are obtained by the reaction of a mixture of olefinic monomers having from 2 to about 50 carbon atoms and, if desired, one or more ethylenically unsaturated polar monomers with sulfur dioxide whereby one obtains an oil-soluble polymer useful in this invention. Although the resulting copolymer can be considered an alternating polymer of the ethylenically unsaturated monomers and sulfur dioxide, it is to be understood that in some instances the respective molar amounts of the sulfur dioxide and the copolymerizable content (the ethylenically unsaturated olefins and polar monomers) contained within the sulfone copolymer may not be the same. For example, in the presence of a suitable polymerization catalyst such as those hereinafter described, it would be expected that some homopolymerization of the olefin or polar monomer would take place thereby producing a copolymer containing more than 50 mole % of the olefin monomer and if present the polar monomer. The present invention, therefore, contemplates the use of a sulfone copolymer comprising from about 50 to about 70 mole % of olefins plus polar monomer and from about 30 to about 50 mole % of sulfur dioxide.

The sulfone copolymers suitably employed in this invention may contain a minor amount, i.e., up to about 30 mol % (based upon the olefin content only) of a straight or branched chain diene. Any unsaturation extant in the co-polymer can be removed as desired by hydrogenation or utilized as a reaction means for attaching hydrocarbon chains whereby the oil solubility is tailored to a particular application.

The preferred monoolefins when reacted with the sulfur dioxide provide for pendant alkyl side chain groups extant in the oil soluble sulfone copolymer which average from about 10 to about 20 carbons, optimally 11 to 15 carbons.

To more fully understand the nature of this invention the olefinic and polar monomers which may be polymerized to prepare the sulfone copolymers useful in combination with said ethylene polymers will be hereafter discussed in detail.

A. Olefinic Monomers

Olefinic monomers which are suitable for the practice of this invention to provide the sulfone copolymers include substantially linear $O_2$ to $C_{50}$ monoolefins having a Type I structure $R\text{-}CH{=}CH_2$; Type II structure $R\text{-}CH{=}CHR'$ and Type III structure $R'(R'')C{=}CH_2$ wherein R, R' and R'' are independently selected from the group consisting of hydrogen; straight and branched-chain alkyl; aryl; alkylaryl; aryl-alkyl and cycloalkyl. As earlier noted the olefinic monomers can contain up to about 30 mol percent dienes.

Non-limiting examples of Type I olefins include ethylene, propylene; 1-butene; 1-pentene; 1-hexene; 4-methyl-1-pentene; 4,4-dimethyl-1-pentene; 1-dodecene; 1-octadecene; styrene; 4-methyl styrene; 3-phenyl-1-propene; vinyl cyclohexane; 2-vinyl norbornene; and vinyl naphthalene. Type II examples include 2-butene; 2-pentene; 3-hexene; 4-octene; 5-octene; norbornene; cyclohexene; and cyclopentene.

Non-limiting examples of suitable Type III olefins include: isobutylene; 2,3-dimethyl-1-butene; 2,4,4-trimethyl-1-pentene; 2,6-dimethyl-1-octene, 4-isopropenyl toluene; isopropenyl cyclohexane; and α-methyl styrene.

The dienes include straight and branched chain acyclic and alicyclic, conjugated and non-conjugated dienes.

Non-limiting examples of conjugated diolefins, preferably $C_4$ to $C_{10}$ acyclic conjugated diolefins, which may be interpolymerized with the polar and olefinic monomers include: butadiene, isoprene; cis and trans piperylene; 2,3-dimethyl-1,3-butadiene; 1,3-hexadiene; 3,7-dimethyl-1,3-octadiene and 3-(4-methylpentyl)-1,3-butadiene.

Representative non-limiting examples of nonconjugated diolefins include:

A. straight chain acyclic dienes such as: 1,4-hexadiene; 1,5-heptadiene, 1,6-octadiene.

B. Branched chain cylic dienes such as: 5-methyl-1,4-hexadiene; 3,7-dimethyl 1,6-octadiene; 3,7-di-methyl 1,7-octadiene; and the mixed isomers of dihydromyrcene and dihydroocimene.

C. Single ring alicyclic dienes such as: 1,4-cyclohexadiene; 1,5-cyclo-octadiene; 1,5-cyclododecadiene; 4-vinylcyclohexene; 1-allyl 4-isopropylidene cyclohexane; 3-allylcyclopentene; 4-allyl-cyclohexene and 1-isopropenyl 4(4-butenyl) cyclohexane.

D. multi-single ring alicyclic dienes such as: 4,4'-dicyclopentenyl and 4,4'-dicyclohexenyl dienes.

E. Multi-ring alicyclic fused and bridged ring dienes such as: tetrahydroindene; methyl tetrahydroindene; dicyclopentadiene; bicyclo(2,2,1) hepta 2,5-diene; alkenyl, alkylidene, cycloalkenyl and cycloalkylidene norbornenes such as: 5-methylene-2-norbornene; 5-ethylidene-2-norbornene; 5-methylene-6-methyl-2-norbornene; 5-methylene-6,6-dimethyl--norbornene; 5-propenyl-2-norbornene; 5-(3-cyclopentenyl)-2-norbornene and 5-cyclohexylidene-2-norbornene.

The sulfone copolymers derived solely from the olefins usefully contain a total of from up to about 50 to about 70 mole % of olefin monomer units; however, the diolefin monomer units thereof can range up to a total of about 20 mole % of the copolymer.

B. Ethylenically unsaturated Polar Monomers the

The polar monomers suitable for admixture with the olefinic monomers in the practice of this invention are monoethylenically unsaturated polar monomers which are co-polymerizable with $SO_2$. The polar monomers have a total of 8 to 52, preferably 10 to 28 carbons and generally consist of carbon, hydrogen and one or more atoms selected from the groups consisting of oxygen, nitrogen, halogen and sulfur.

In preferred sense these polar monomers may be represented by the general formula:

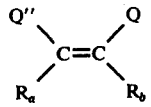

wherein $R_a$ and $R_b$ are independently selected from the group consisting of hydrogen, halogen and a $C_1$ to $C_{12}$ alkyl radical such as methyl and Q is selected from the group consisting of carboxy (—COOH); cyano (—CN); hydroxy methyl (—$CH_2$—OH); and carboalkoxy (—COOR'''), wherein R''' is selected from the group consisting of $C_1$ to $C_{24}$ straight and branched-chain alkyl, arylalkyl, and cycloalkyl radicals; alkoxy methyl (—$CH_2$—O—R''') and methyl hydrocarbyl ketone (—$CH_2$—CO—R''') wherein R''' is as above; hydrocarbyl ketone (—O—R''') wherein R''' is as above; and Q'' is selected from the group consisting of hydrogen; carboxy (—COOH); cyano (—CN); and carboalkoxy (—COOR''') wherein R''' has the meaning set forth above.

Particularly preferred are $C_1$ to $C_{22}$ acyclic or alicyclic esters of acrylic acid which are illustrated by the general formula $CH_2$=CH—$COOR^{IV}$ wherein $R^{IV}$ is selected from the group consisting of straight or branched-chain alkyl radicals, arylalkyl radicals, cycloalkyl-alkylene radicals, and perfluoroalkyl radicals. Non-limiting examples are: methyl; ethyl; n-propyl; n-butyl; isobutyl; n-amyl; n-hexyl; 2-ethyl-hexyl; n-octyl; isooctyl derived by the oxonation of mixed heptenes followed by hydrogenation; isodecyl; 3,5,5-trimethyl hexyl; n-dodecyl; tridecyl; tetradecyl; heptadecyl; octadecyl; eicosenyl; docosenyl; benzyl and cyclohexyl radicals.

Another preferred subclass of polar monomers for preparation of the sulfone copolymer is (a) a fumaric acid ester or amide, (b) a maleic acid derivative, or (c) a $C_1$–$C_{22}$ alkyl maleate ester. Specifically, the most suitable members of this subclass are fumarate esters, maleate esters, maleic anhydride and methyl maleic anhydride (known as citraconic anhydride).

Another preferred subclass of polar monomers are $C_9$ to $C_{18}$ halomethyl aromatic vinyl compounds which are illustrated by the general formula $CH_2$=CH—$R^V$—$CH_2$—X wherein $R^V$ is an arylene radical having from 1 to 3 rings and X is a halogen independently selected from the group consisting of chlorine, bromine and iodine. Non-limiting examples include: 3-chloromethyl-1-styrene; 4-chloromethylstyrene; 1-vinyl-4-chloromethyl naphthalene; 4-chloromethyl-2,3,5,6-tetramethyl styrene; 4-bromomethyl styrene; 3-chloromethyl-4-methyl styrene; 3methoxy-4-chloromethyl styrene.

PREPARATION OF SULFONE COPOLYMERS

In general, the sulfone copolymers are prepared by dissolving the olefinic and polar monomers in an inert solvent, thereafter saturating the solution with sulfur dioxide gas and while maintaining $SO_2$ flow through the reaction system, adding a catalyst. Preferably, the catalyst is added as a solution to the reaction system in periodic aliquot portions. The temperature of the polymerization medium is controlled and kept below the ceiling temperature for the monomers, i.e., the temperature above which the monomers will not polymerize. If desired, the olefins in part or whole can be added with the catalyst solution or shortly after its introduction into the polymerization system.

The inert solvent used for the reaction can be of three general types, i.e. hydrocarbons, halogenated hydrocarbons and glycol ethers. Examples of the first group are benzene, n-hexane, diethyl benzene, naphtha, kerosene, etc. Examples of the second group are perchloroethylene, methylene chloride, trichlorobenzene, carbon tetrachloride, etc. Examples of the third group are diethylene glycol, di-methyl ether, diethylene glycol ether, ethylene glycol di-methyl ether, etc.

The polymerization catalyst which can be used in this process is preferably of the free radical type. Examples of the free radical catalysts are, in general, any of the conventional free radical catalysts, for example, those of the peroxide or azo-types. By way of example, suitable peroxide-type catlysts include benzoyl peroxide, ditertiary butyl peroxide, tertiary butyl hydroperoxide, diacetyl peroxide, diethyl peroxycarbonate, 2-phenyl propane-2-hydroperoxide (known also as cumene hydroperoxide). The azo-type catalysts are characterized by the presence in the molecule of the group —N=λ N—bonded to one or two organic radicals, preferably at least one of the bonds being to a tertiary carbon atom. Suitable azo type catalysts are exemplified by α, α azodiisobutyronitrile, p-bromobenzenediazonium fluoroborate, N-nitroso-p-bromoacetanilide, azomethane, phenyldiazonium halides, diazoaminobenzene, p-bromobenzenediazonium hydroxide and p-tolyldiazoaminobenzene. The polymerization catalyst is used in small amounts, which are generally not in excess of two percent by weight based upon the monomeric material. A suitable quantity is often in the range of 0.05 to 0.5 percent by weight.

As the temperature of the reaction should not exceed the boiling temperature of the olefins or polar monomers, it practically ranges from about −50° to about 100° C. with a preferred range from about −30° to 30° C. The polymerization pressure can range from about 1 to 30 atmospheres.

Reaction time may vary widely, depending upon the reactivity of the particular monomers, catalyst concentration and temperature of the reaction. Accordingly, polymerization times may vary from as little as 1 minute to 15 hours; with the preferred ranging from 5 minutes to 3 hours.

Preparation of a sulfone copolymer of sulfur dioxide and $C_{10-50}$ alphs olefins has been generally described in U.S. Pat. No. 3,442,790.

The distillate hydrocarbon oils which are treated with the co-additives of this invention, include cracked and virgin distillate oils boiling in the broad range of 120° to 480° C., and conventionally at from about 175° to about 400° C. such as heating oil and diesel fuel oil as measured by ASTM Method D-86.

The distillate oil of the invention can comprise a blend in any proportion of straight run and thermally and/or catalytically cracked distillates, or blends of middle distillates and heavy distillates, etc. The invention is particularly applicable and effective for the cold flow treatment of high end point fuels, i.e., those fuels wherein at least about 5 wt. % boil at a temperature of greater than about 350° C.

The conbinations of the invention may be used alone or in combination with still other oil additives, e.g., corrosion inhibitors; antioxidants; sludge inhibitors; etc.

The invention will be further understood by reference to the following examples which include preferred embodiments of the invention.

EXAMPLES

The following materials were used:

Polymer 1

Polymer 1 is a copolymer of ethylene and vinyl acetate. This copolymer was prepared by the following procedure. A 3 liter stirred autoclave was charged with 120 ml. of vinyl acetate in 700 ml. of benzene as solvent. The autoclave was then purged with nitrogen and then with ethylene. The autoclave was then heated to 95° C. while ethylene was pressured into the autoclave until the pressure was raised to 1800 psig. Then, while maintaining a temperature of 95° C. and said 1800 psig pressure, 25 ml/hr. of vinyl acetate and a solution consisting of 5 wt. % di-lauroyl peroxide dissolved in benzene, were continuously pumped into the autoclave at an even rate. A total of 50 ml. of vinyl acetate was injected over 2 hours while 9 g. of the peroxide in the form of the solution was injected into the reactor over a period of 2 hours from the start of the injection. After the last of said peroxide was injected, the batch was maintained at 95° C. for an additional 10 minutes. Then, the temperature of the reactor contents was lowered to about 60° C., the reactor was depressurized, and the contents were discharged from the autoclave. The reactor was rinsed with 1 liter of warm benzene (about 50° C) which was added to the product. The product was then stripped of the solvent and unreacted monomers on a steam bath overnight by blowing nitrogen through the product. The final stripped product consisted of about 145 grams of copolymer of ethylene and vinyl acetate having a number average molecular weight of 3922 (as measured by VPO) and an ester content of 20.1 wt. %.

Polymer A

Polymer A was a sulfone copolymer of sulfur dioxide and a mixture of $C_{12-20}$ alpha olefins with (Mn) of about 9307. The polymerization was carried out on an olefin charge of 4.65 g (0.03 mole) of dodecene-1; 18.55 g (0.07 mole) of tetradecene-1; 11.54 g (0.05 of mole) of hexadecene-1; 8.68 g. (0.03 mole) of octadecene-1, and 4.82 g (0.02 mole) of eicosene-1 dissolved in 43.2 g. of benzene contained in a 1 liter water cooled flask having a stiner and separate means for introducing and maintaining a slight positive pressure of $SO_2$ on the contents and introducing of the free radical catalyst solution. 36 g. (0.5 mole) of $SO_2$ were present during a polymerization period of 110 minutes provoked by periodic introduction of 10 ml. aliquot portions of catalyst solution (0.5 g of t-butyl hydroperoxide in 50 ml. of benzene). The temperature during polymerization was maintained at from 10°–15° C. After a nitrogen sparge of the reaction vessel and introduction of 50 ml. of benzene, the polymer was separated by dissolution in methanol. After evaporation of the methanol, the polymer of approximately 50 mol % $SO_2$ and 50 mol % olefins was obtained in a yield of 51.9 grams.

POLYMER B

Polymer B was a sulfone copolymer obtained from the reaction of an excess 0.9 mole of $SO_2$ and 0.25 mole of a mixture of $C_{14}$–$C_{20}$ olefin-1s. The procedure of preparing Polymer A was used with an olefin charge of: 29.0 g (0.15 mole) of tetradecene-1; 11.78 g (0.05 mole) of hexadecene-1; 5.05 g (0.02 mole) of octadecene-1; and 7.72 g. (0.03 mole) of eicosene-1 dissolved in 53.6 g. of benzene. The time of polymerization was 73 minutes and the temperature ranged from 10° to 24° C. The sulfone copolymer yield was 65 g. of an equimolar polymer of $SO_2$ and olefins having a ($\overline{M}_n$) of 12,556.

POLYMER C

Polymer C was obtained from the polymerization of an excess (0.9 mole) of $SO_2$ and 0.255 mole of a mixture of $C_{14}$–$C_{20}$ olefin-1s. The procedure of Polymer A was used with the olefin-1s charge being: 34.13 g. (0.18 mole) of tetradecene-1; 8.64 g. (0.04 mole) of hexadecene-1; 3.73 g. (0.015 mole) of octadecene-1; and 5.68 g. (0.02 mole) of eicosene-1 dissolved in 52.18 g. of benzene. The reaction time was 65 minutes and the temperature ranged from 10° to 13° C. The sulfone copolymer yield was 65 g. of an equimolar polymer of $SO_2$ and olefins having a ($\overline{M}_n$) of 14,432.

The Fuel

The property of the distillate fuel oil tested is summarized in Table I which follows:

TABLE I

| Properties | Fuel |
|---|---|
| Gravity, 16° C. | 0.8265 |
| Cloud Point, ° C. | +1 |
| Aniline Point, ° C. | 71 |
| Distillation, ° C.* | |
| IBP | 156 |
| 20% | 185 |
| 50% | 261 |
| 80% | 328 |
| 95% | 353 |
| FBP | 355 |
| N-Paraffin range | $C_9$–$C_{30}$ |

*measured by ASTM-D1160

Various blends of Polymer 1 with Polymers A to C in the fuel were made by simply dissolving the polymers in the fuel oil. This was done while warming, e.g., heating the oil and polymer to about 90° C. if the polymer per se was added, and stirring. In other cases, the polymer was simply added with stirring to the fuel in the form of an oil concentrate which was usually about 50 wt. % polymer dissolved in a light mineral oil.

The blends were then tested for their cold flow properties in the test described below.

THE COLD FILTER PLUGGING POINT TEST (CFPPT)

The cold flow properties of the blend were determined by the Cold Filter Plugging Point Test (CFPPT). This test is carried out by the procedure described in detail in "Journal of the Institute of Petroleum," Volume 52, Number 510, June 1966 pp. 173–185. In brief, the Cold Filter Plugging Point Test is carried out with a 45 ml. sample of the oil to be tested which is cooled in a bath maintained at about −34° C. Every 1° drop in temperature, starting from 2° C. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7 inches of water is applied to the upper end of the pipette by means of a vacuum line while the screen is immersed in the oil sample. Due to the vacuum, oil is drawn across the screen up into the pipette to a mark indicating 20 ml. of oil. The test is repeated with each one degree drop in temperature until the oil fails to fill the pipette to the aforesaid mark due to clogging of the screen with wax crystals. Thee results of the test are reported as the temperature in °C. at which the oils fail to fill the pipette in the prescribed time.

The blends prepared and the test results are summarized in Table II which follows:

TABLE II

| EFFECTIVENESS OF POLYMERS IN THE FUEL | | |
|---|---|---|
| Example | Polymer | CFPPT, ° C. |
| 1 | None | +2 |
| 2 | 0.04% Polymer 1 | −4 |
| 3 | 0.04% Polymer A | +2 |
| 4 | 0.04% Polymer B | +2 |
| 5 | 0.04% Polymer C | +2 |
| 6 | 0.02% Polymer 1) 0.02% Polymer A) | −13 |
| 7 | 0.02% Polymer 1) 0.02% Polymer B) | −12 |
| 8 | 0.02% Polymer 1) 0.02% Polymer C) | −11 |

The improved synergistic results obtained by the teachings of this invention are apparent from the foregoing Table, e.g. the blend of Example 2 gives a CFPPT of −4° C. whereas 50/50 mixtures of the blends of Exs. 2 and 3, i.e., 6, gives a markedly lower CFPPT of −13° C. (similarly, synergism is obvious in the results of Examples 7 and 8 whereby the CFPPT is lowered 7° to 8° C.

In its preferred form, the sulfone copolymer will contain at least 15 wt. %, more usually at least 25 wt. %, of the copolymer in the form of substantially linear, $C_{10}$ to $C_{20}$, e.g., $C_{12}$ to $C_{18}$, alkyl groups which can be derived either from the aforesaid olefin or unsaturated polar monomers, (e.g., unsaturated alkyl esters) or mixtures of in any proportion of said olefins or said polar monomers, e.g., 0.1 to 10 moles of olefins per mole of polar monomer. Mixtures of two or more alpha olefins in any proportion, particularly those in the $C_{12}$ to $C_{22}$ range are particularly effective, for example, 10 to 80 mole % of one or more $C_{12}$ to $C_{16}$ olefin with 90 to 20 mole % of a higher $C_{18}$ to $C_{20}$ olefin.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. A distillate petroleum fuel oil boiling in the range of 120° to 480° C. of which about at least 5 wt. % boils above 350° C., which has been improved in its low temperature flow properties, containing in the range of about 0.005 to 0.1 wt. %, based on the weight of the total composition, of a flow improving synergistic combination of (a) one part by weight of ann oil soluble ethylene backbone middle distillate pour point depressing polymer having a number average molecular weight in the range of about 1000 to 60,000 per (b) 0.2 to 5 parts by weight of an oil-soluble sulfone copolymer having a number average molecular weight in the range of about 800 to 500,000;

wherein said ethylene backbone polymer consists essentially of 3 to 40 molar proportions of ethylene copolymerized with a molar proportion of ethylenically unsaturated alkyl ester of the formula:

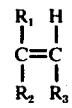

wherein $R_1$ is hydrogen or methyl; $R_2$ is a —$OOCR_4$ or —$COOR_4$ group wherein $R_4$ is hydrogen or a $C_1$ to $C_8$ alkyl group, and $R_3$ is hydrogen or —$COOR_4$, and mixtures of said esters; and wherein said sulfone copolymer comprises from about 50 to about 70 mole % of $C_2$ to $C_{50}$ substantially linear olefins and from about 30 to about 50 mole % of sulfur dioxide, and at least 25 wt. % of said sulfone copolymer is in the form of substantially linear $C_{10}$ to $C_{20}$ alkyl groups.

2. A fuel oil according to claim 1, wherein said ethylene backbone polymer is a copolymer of ethylene and vinyl acetate of about 1000 to 7000 molecular weight.

3. A fuel oil according to claim 1, wherein said sulfone copolymer is a copolymer of sulfur dioxide and $C_{12}$ to $C_{22}$ alpha olefin.

4. A fuel oil according to claim 3, wherein said alpha olefin is a mixture of about 10 to 80 mole % $C_{12-16}$ olefin and about 20 to 90 mole % of $C_{18-20}$ olefin.

5. An additive concentrate for improving the low temperature flow properties of distillate petroleum fuel oils comprising mineral oil containing 1 to 60 wt. % of an additive combination of (a) one part by weight of an oil soluble ethylene backbone middle distillate pour point depressing polymer having a number average molecular weight in the range of about 1000 to 60,000 per (b) 0.2 to 5 parts by weight of an oil-soluble sulfone copolymer having a number average molecular weight in the range of about 800 to 500,000;

wherein said ethylene backbone polymer consists essentially of 3 to 40 molar proportions of ethylene copolymerized with a molar proportion of ethylenically unsaturated alkyl ester of the formula:

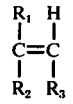

wherein $R_1$ is hydrogen or methyl; $R_2$ is a $—OOCR_4$ or $—COOR_4$ group wherein $R_4$ is hydrogen or a $C_1$ to $C_8$ alkyl group, and $R_3$ is hydrogen or $—COOR_4$, and mixtures of said esters; and wherein said sulfone copolymer comprises from about 50 to about 70 mole % of $C_2$ to $C_{50}$ substantially linear olefins and from about 30 to about 50 mole % of sulfur dioxide, and at least 25 wt. % of said sulfone copolymer is in the form of substantially linear $C_{10}$ to $C_{20}$ alkyl groups.

6. An additive concentrate according to claim 5, wherein said ethylene backbone polymer is a copolymer of ethylene and vinyl acetate of about 1000 to 7000 molecular weight.

7. An additive concentrate according to claim 6, wherein said sulfone copolymer is a copolymer of sulfur dioxide and $C_{12}$ to $C_{22}$ alpha olefin.

8. An additive concentrate according to claim 7, wherein said alpha olefin is a mixture of about 10 to 80 mole % $C_{12-16}$ olefin and about 20 to 90 mole % of $C_{18-20}$ olefin.

* * * * *